US005632638A

United States Patent [19]

Matsushita et al.

[11] Patent Number: 5,632,638

[45] Date of Patent: May 27, 1997

[54] CARD EDGE CONNECTOR

[75] Inventors: Yasuo Matsushita; Hisashi Konoya; Mitsuhiro Fujitani, all of Yokkaichi, Japan

[73] Assignee: Sumitomo Wiring Systems, Ltd., Mie, Japan

[21] Appl. No.: 264,373

[22] Filed: Jun. 23, 1994

[30] Foreign Application Priority Data

| | | | |
|---|---|---|---|
| Aug. 6, 1993 | [JP] | Japan | 5-215036 |
| Oct. 28, 1993 | [JP] | Japan | 5-294018 |
| Oct. 28, 1993 | [JP] | Japan | 5-294019 |

[51] Int. Cl.[6] ..... H01R 9/09

[52] U.S. Cl. ..... 439/260; 439/262

[58] Field of Search ..... 439/259, 260, 439/261, 263, 265–268, 629–632, 62

[56] References Cited

U.S. PATENT DOCUMENTS

| | | | |
|---|---|---|---|
| 3,526,869 | 9/1970 | Conrad et al. | 439/260 |
| 4,148,537 | 4/1979 | Sochor | 439/260 |
| 4,863,395 | 9/1989 | Babuka et al. | 439/260 |

FOREIGN PATENT DOCUMENTS

| | | |
|---|---|---|
| 0274684 | 7/1988 | European Pat. Off. . |
| 0366533 | 5/1990 | European Pat. Off. . |
| 2310061 | 4/1975 | France . |
| 1640392 | 2/1971 | Germany . |
| 56-136480 | 10/1981 | Japan . |

OTHER PUBLICATIONS

IBM Technical Disclosure Bulletin, Pluggable Flex Circuit Connector with Sequence Features, Nov. 1990, vol. 33 No. 6B.

*Primary Examiner*—Hien Vu
*Attorney, Agent, or Firm*—Oliff & Berridge

[57] ABSTRACT

In a card edge connector, rotating pins are formed on the inner surfaces of the side walls of a box-shaped outer housing, while cylindrical bearings are formed on the outer surfaces of the side walls of inner housings in which electrically conductive terminals are accommodated. The inner housings are swingably held with the rotating pins engaged with the cylindrical bearings. The cylindrical bearings have cut-outs in the cylindrical walls which are opened in the direction of insertion, so that, as the inner housings are pushed into the outer housing, the rotating pins are engaged with the cylindrical bearings through the cut-outs. The inner housings are urged by spring members in such a manner that the abutting parts of the terminals are moved away from terminals formed on the connecting end portion of a printed circuit board. When the connecting end portion of the printed circuit board starts to enter the outer housing is started, the connecting end portion gently touches the abutting parts of the terminals. When the connecting end portion is fully pushed into the outer housing, introducing cams, which are formed on a hood surrounding the connecting end portion, cause the inner housings to swing towards the connecting end portion, so that the terminals are positively pushed against the abutting parts.

11 Claims, 10 Drawing Sheets

CARD EDGE CONNECTOR

BACKGROUND OF THE INVENTION

This invention relates to a card edge connector having a plurality of metal terminals the tongue pieces of which are pushed against a plurality of elongated terminals which are formed on both sides of the connecting end portion of a printed circuit board, so that the terminals of the card edge connector are electrically connected to the terminals of the printed circuit board.

A card edge connector is engaged with a printed circuit lo board in such a manner that it holds an edge portion of the printed circuit board, namely, a connecting end portion. The connecting end portion is designed as follows: At a predetermined edge portion of the printed circuit board, parts of the printed lines are formed into elongated terminals which are arranged side by side on both sides of the edge portion. A conventional card edge connector of this type is as shown in FIGS. 1 and 2.

Terminals (not shown) are formed on both sides of an end portion 1 of a printed circuit board. On the other hand, the card edge connector 2 has a box-shaped housing 3 having a slit-shaped inserting hole 4 into which the connecting end portion 1 is inserted. The housing 3 holds metal terminals 5 in such a manner that the metal terminals define a narrow space which is extended from the inserting hole 4 to the back. Each of the terminals 5 has a tongue-shaped abutting part 6 which is flexible and protruded towards the narrow space.

The card edge connector 2 is engaged with the connecting end portion 1 of the printed circuit board as follows: First, the edge of the connecting end portion 1 is set in the inserting hole 4 of the housing 3, and then the connecting end portion 1 is pushed into the inserting hole 4. In this operation, the connecting end portion 1 is moved towards the back while pushing the tongue-shaped abutting parts 6 away from each other which are protruded into the space from both sides which is located behind the inserting hole 4.

When the connecting end portion 1 is inserted into the card edge connector, it is obliquely abutted against the abutting parts 6, so that it deflects the abutting parts 6 while sliding on the latter 6. However, when the abutting parts 6 are pushed away from each other by the connecting end portion 1, the resistance against the pushing operation is relatively large. Hence, the connecting end portion 1 does not smoothly slide on the abutting parts 6 depending on the way of insertion, and at worst the abutting parts 6 may be deformed. Furthermore, since the resistance is great, the engagement of the card edge connector is low in work efficiency.

Furthermore, the connecting end portion la of the printed circuit board, which has been protruded through the engaging surface 14 of the board holder 10, is liable to vertically deflect as indicated by the two-dot chain lines in FIG. 3, depending on how the printed circuit board 12 has been fixed to the board holder 10. This difficulty is due to the fact that, when the printed circuit board is secured to the board holder with a plurality of screws as shown in FIG. xx, the screws are not uniform in vertical position, or tightened with different forces, or the printed circuit board itself is curved. If the connecting end portion la of the printed circuit board is deflected vertically as was described above, then the following difficulties are involved: The card edge connector 2 cannot be engaged with the connecting end portion la of the printed circuit board without twisting it; that is, it is difficult to smoothly engage the former with the latter; in other words, the engagement of the card edge connector with the printed circuit board is low in work efficiency. Furthermore, the twisting of the connecting end portion may deform or damage the abutting parts 6. That is, the engagement of the card edge connector with the printed circuit board is low in reliability.

SUMMARY OF THE INVENTION

In view of the foregoing, an object of this invention is to provide a card edge connector which can be readily engaged with a plate-shaped member such as a printed circuit board, and which is free from difficulties that the work efficiency is lowered, and the electrically conductive terminals are deformed.

Furthermore, another object of this invention is to provide a board holding structure with which a printed circuit board can be engaged with a card edge connector with high efficiency, and in connecting the printed circuit board to the card edge connector, it is unnecessary to twist the connecting end portion, and accordingly the abutting parts are prevented from damage.

The foregoing object of the invention has been achieved by the provision of a card edge connector holding a plurality of electrically conductive terminals, the abutting parts of which are brought into contact with exposed terminals which are formed on the connecting end portion of a plate-shape member at predetermined positions, thus being electrically connected to the terminals; which, according to the invention, comprises: inner housings holding the electrically conductive terminals in such a manner that the abutting parts thereof are protruded in a predetermined direction; an outer housing having an inserting hole in a first end wall into which the connecting end portion of the plate-shaped member is inserted, and an opening in a second end wall opposite to the first end wall through which the inner housings are inserted into the outer housing; holding mechanisms for swingably holding the inner housings so that, in the outer housing, the abutting parts of the electrically conductive terminals held in the inner housings are brought into or out of contact with the exposed terminals on the connecting end portion of the plate-shaped member; and a turning mechanism for turning the inner housings in such a manner that, when the connecting end portion of the plate-shaped member is inserted into the outer housing, the abutting parts of the electrically conductive terminals held in the inner housings are brought into contact with the exposed terminals on the connecting end portion of the plate-shaped member, and when the connecting end portion of the plate-shaped member is removed from the outer housing, the abutting parts are moved out of contact, each holding mechanism comprising: a pair of rotating pins formed on the inner surface of a side wall of the outer housing; and cylindrical bearings formed on the outer surfaces of side walls of the inner housings, the cylindrical bearings being engaged with the rotating pins so as to swingably hold the inner housings, each cylindrical bearing having a cylindrical side wall in which a cut-out is formed, so that the rotating pin are held in the cylindrical bearing when pushed through the cut-out thereinto from the side, the cut-out being opened in the direction of insertion of the inner housings into the outer housing.

In the card edge connector, a pair of the inner housings are provided for the exposed terminals on both sides of the connecting end portion of the plate-shaped member.

Furthermore, in the card edge connector, the turning mechanism comprises: spring mechanisms for turning the inner housings to move the abutting parts of the electrically conductive terminals away from the exposed terminals of the connecting end portion of the plate-shaped member; and a cam mechanism for turning the inner housings in such a manner that, when the inner housings are moved towards the connecting end portion, the abutting parts of the electrically conductive terminals approach the terminals of the connecting end portion of the plate-shaped member, each spring mechanism comprising: an outer holding member formed on the inner surface of a side wall of the outer housing in such a manner that the outer hold member is located between the rotating pins of the holding mechanism provided for the inner housings; a pair of inner holding members formed respectively on the outer surfaces of the side walls of the inner housings which are on the side where the holding mechanism is provided, in such a manner that the inner holding members are protruded toward the inner surfaces of the side walls of the outer housing; and a pair of elastic spring members each comprising a middle portion and the remaining end portions, the elastic spring members being each mounted between the outer housing and the inner housings with the middle portion locked to the outer holding member and with the end portions engaged with the inner holding members to swing the inner housings away from each other.

According to second aspect of the invention, a card edge connector holding a plurality of electrically conductive terminals, the abutting parts of which are brought into contact with exposed terminals which are formed on the connecting end portion of a plate-shape member at predetermined positions, thus being electrically connected to the terminals; which, according to the invention, comprises: an inner housing assembly including: a pair of box-shaped inner housings holding the electrically conductive terminals in such a manner that the abutting parts thereof are protruded in a predetermined direction; and a hinge mechanism which swingably holds the inner housings which are set in such a manner that the abutting parts in one of the inner housings are confronted with the abutting parts in the other inner housing, so that the abutting parts are moved to and from each other as the inner housings are swung, an outer housing having an inserting hole in a first end wall into which the connecting end portion of the plate-shaped member is inserted, and an opening in a second end wall opposite to the first end wall through which the inner housing assembly is inserted into the outer housing, the outer housing swingably accommodating the inner housing assembly; and a turning mechanism for turning the inner housings of the inner housing assembly in such a manner that, when the connecting end portion of the plate-shaped member is inserted into the outer housing, the abutting parts of the electrically conductive terminals held in the inner housings of the inner housing assembly are brought into contact with the exposed terminals on the connecting end portion of the plate-shaped member, and where the connecting end portion of the plate-shaped member is removed from the outer housing, the abutting parts are moved out of contact.

In the card edge connector, the hinge mechanism comprises: a male member which is protruded from a side wall of one of the inner housings of the inner housing assembly to a side wall of the other inner housing, and has a rotating pin extended therefrom along the axis of rotation of the one inner housing; and a female member which is protruded from the side wall of the other inner housing to the side wall of the one inner housing, and has a through-hole therein into which the rotating pin is inserted.

Furthermore, in the card edge connector, each of the inner housings has the male member and the female member, thus providing a pair of said hinge mechanisms.

According to third aspect of the invention, a board holding structure of the card edge connector, which comprises: a printed circuit board having a connecting end portion on which a plurality of terminals are arranged in the direction of width thereof, the connecting end portion being engaged with a card edge connector; a board holder which holds the printed circuit board with the connecting end portion protruded through the engaging surface of the board holder which is engaged with the card edge connector; and a posture correcting member extended from the engaging surface of the board holder, for holding the connecting end portion of the printed circuit board.

In the card edge connector of first aspect of the invention, the inner housings holding the electrically conductive terminals in such a manner that the abutting parts thereof are protruded in a predetermined direction, are swingably held in the outer housing by the holding mechanisms. As the inner housings are swung in the outer housing, the abutting parts of the electrically conductive terminals are brought into and out of contact with the exposed terminals on the connecting end portion of the plate-shaped member. The turning mechanism turns the inner housings in such a manner that, when the connecting end portion of the plate-shaped member is inserted into the outer housing, the abutting parts of the electrically conductive terminals are brought into contact with the exposed terminals on the connecting end portion of the plate-shaped member, and when the connecting end portion of the plate-shaped member is removed from the outer housing, the abutting parts are moved out of contact.

The outer housing has the inserting hole in the first end wall into which the connecting end portion of the plate-shaped member is inserted, and the opening in the second end wall opposite to the first end wall through which the inner housings are inserted into the outer housing. Each of the holding mechanism comprises: a pair of rotating pins formed on the inner surface of a side wall of the outer housing; and the cylindrical bearings formed on the outer surfaces of side walls of the inner housings, the cylindrical bearings being engaged with the rotating pins so as to swingably hold the inner housings. Each of the cylindrical bearings having the cylindrical side wall with the cut-out which is opened in the direction of insertion of the inner housings. Therefore, as the inner housings are inserted into the outer housing, the rotating pins are pushed into the cylindrical bearings through the cut-outs, so that the rotating pins are rotatably held in the cylindrical bearings.

Further, in the card edge connector, a pair of the inner housings are provided for the exposed terminals on both sides of the connecting end portion of the plate-shaped member, so as to hold the connecting end portion from both sides.

Furthermore, in the card edge connector, the inner housings are urged by the spring mechanisms to move the abutting parts of the electrically conductive terminals away from the exposed terminals on the connecting end portion of the plate-shaped member. Therefore, before the insertion of the connecting end portion of the plate-shaped member, the electrically conductive terminals are not abutted against the connecting end portion. On the other hand, the cam mechanism turns the inner housings as the connecting end portion is moved towards and inserted between the inner housings, so that the abutting parts of the electrically conductive terminals are contact with the exposed terminals on the connecting end portion of the plate-shaped member.

The spring mechanisms are installed as follows: Spring members bent at the middle are engaged with outer holding members which are protruded from the inner surfaces of the side walls of the outer housing and located between the rotating pins of the holding mechanisms, in such a manner that both end portions of each spring member are opened inside the outer housing. The end portions of the spring members thus engaged are locked to the holding mechanisms by inserting the inner housings into the outer housing. Inner holding members are protruded from the outer surfaces of the side walls of the inner housings, which are on the sides where the outer holding members are provided, towards the inner surfaces of the side walls of the outer housing. Hence, as the inner housings are inserted into the outer housing, the inner holding members of the inner housings catch the end portions of the spring members while being moved into the outer housing. Thus, the spring members are engaged with the inner holding members to move the latter away from each other; that is, to swing the inner housings in the opposite directions. As a result, a space large enough to receive the connecting end portion of the plate-shaped member is formed between the inner housings.

In the card edge connector of second aspect of the invention, each of the pair of inner housings forming the inner housing assembly holds the abutting parts of the electrically conductive terminals in such a manner that they are protruded in a predetermined direction, and with the aid of the hinge mechanisms the pair of inner housings are swingably held so that the abutting parts of one of the inner housings and those of the other inner housing, being confronted with each other, are moved to and from each other as the inner housings are swung. The inner housings thus held are inserted into the outer housing through the rear end opening and swingably held in the latter. The outer housing has the inserting hole in the front end wall, which is opposed to the rear end opening, into which the connecting end portion of the plate-shaped member is inserted. As the connecting end portion of the plate-shaped member is pushed into the inserting hole, the inner housings are swung towards each other to cause the abutting parts of the electrically conductive terminals to contact with the exposed terminals on the connecting end portions of the plate-shaped member; whereas as the connecting end portion is pulled out, the inner housings are swung away from each other to cause the abutting parts to move away from the terminals on the connecting end portion of the plate-shaped member.

Further, in the card edge connector, the male member is protruded from a side wall of one of the pair of inner housings towards a side wall of the other inner housing, and has the rotating pin which is extended along the axis of rotation of the inner housing; and the female member is protruded from the side wall of the other inner housing towards the one inner housing, and has the through-hole into which the rotating pin is inserted.

The rotating pin is engaged with the through-hole in advance so that the inner housings are swingably coupled to each other through the male and female members. The inner housings thus coupled are inserted into the outer housing through the rear end opening.

Furthermore, in the card edge connector, each of the inner housings has the male member and the female member; that is, the pair of inner housings are equal in configuration to each other. Hence, by setting one of the inner housings upside down on the other inner housing, the male members are confronted with the female members, respectively. In this case, when the rotating pin of one of the inner housing approaches the through-hole of the other inner housing, simultaneously the rotating pin of the other inner housing approaches the through-hole of the one inner housing. That is, the male members are engaged with the female members at the same time. Thus, the inner housings have been coupled to each other, forming the inner housing assembly.

According to third aspect of the invention, with the board holding structure of the card edge connector, the connecting end portion of the printed circuit board is held by the posture correcting member, thus being prevented from being vertically deflected.

With the board holding structure, the connecting end portion of the printed circuit board is prevented from being vertically deflected. Therefore, the connecting end portion is smoothly engaged with the card edge connector; that is, the engagement of the printed circuit board with the card edge connector is improved in work efficiency.

In addition, since the connecting end portion of the printed circuit board is prevented from being vertically deflected, the connecting end portion will never be twisted when engaged with the card edge connector. Hence, the components of the card edge connector are prevented from being deformed or damaged. Thus, the printed circuit board is engaged with the card edge connector with high reliability.

DETAILED DESCRIPTION OF PREFERRED EMBODIMENTS

The invention will be described with reference to the accompanying drawings.

First Embodiment

Figure 1:
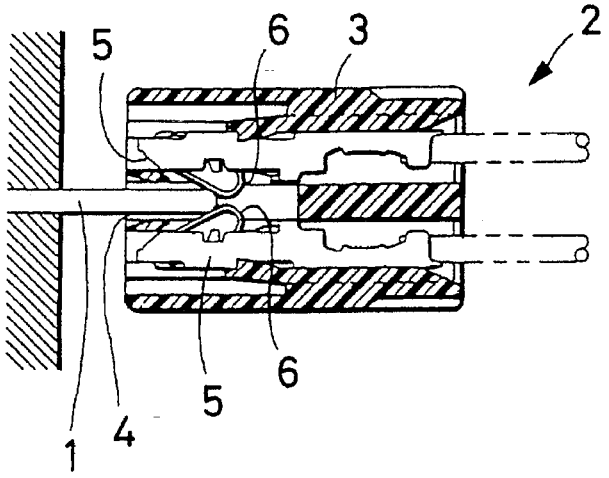
FIG. 1 PRIOR ART
FIGS. 1 to 3 are sectional views for a description of the connection of a conventional card edge connector.
Figure 2:
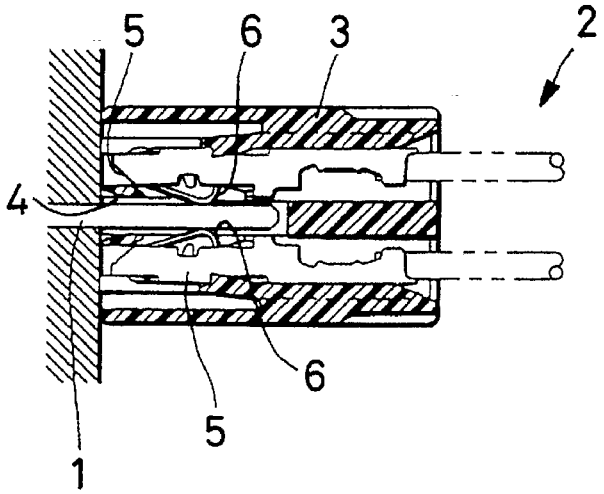
FIG. 2 PRIOR ART
Figure 3:
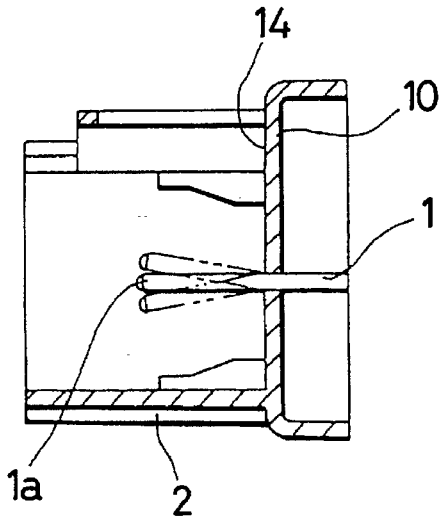
FIG. 3 PRIOR ART
Figure 4:
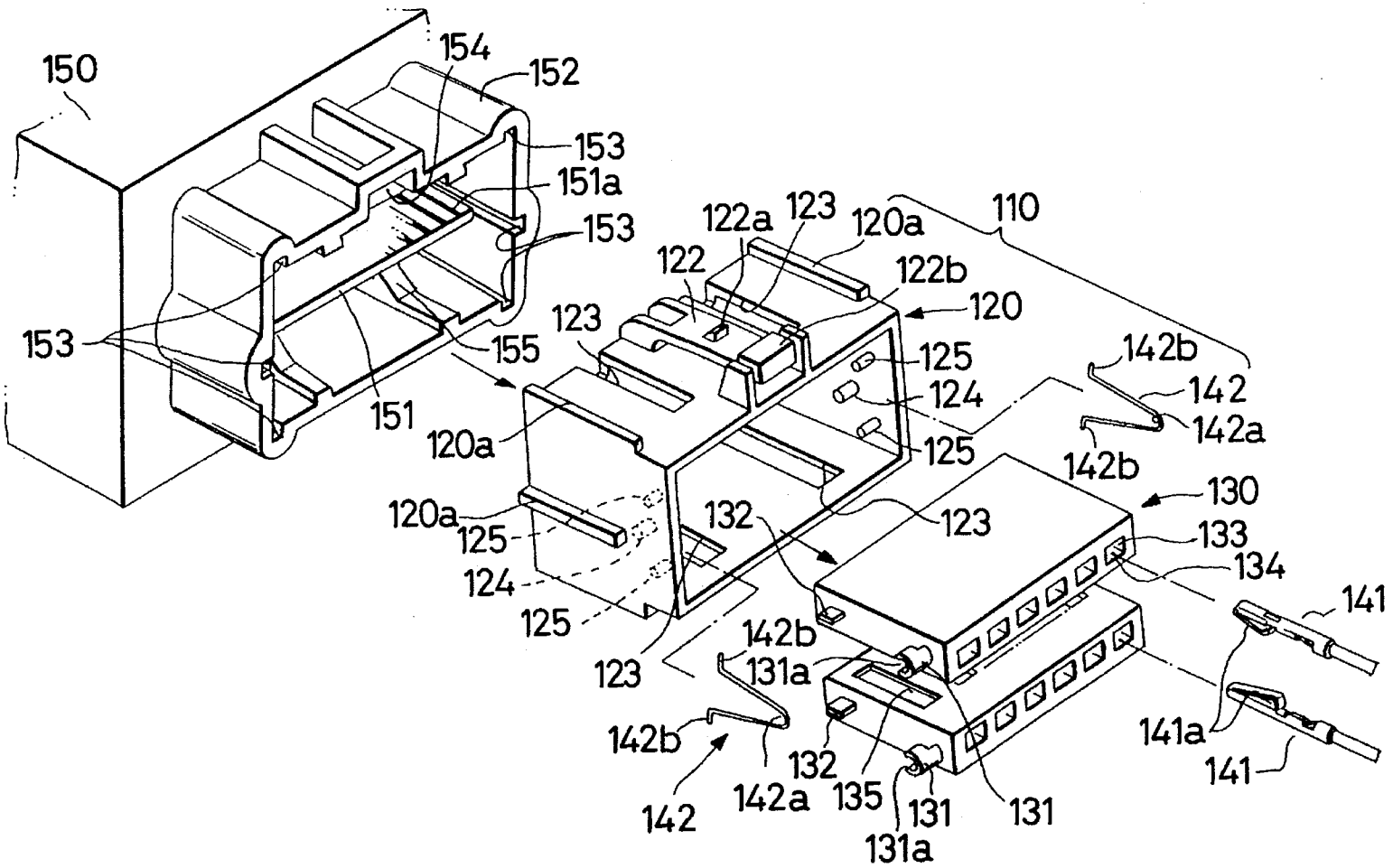
FIG. 4 is an exploded perspective view showing a card edge connector according to first embodiment of this invention.

FIG. 4 is an exploded perspective view of a card edge connection, which constitutes first embodiment of the invention.

As shown in FIG. 4, in the card edge connector 110, two flat-box-shaped inner housings 130 are swingably held in a box-shaped outer housing 120. An inserting hole 121 like a slit is formed in the front wall of the box-shaped outer housing 120 in such a manner that it is extended horizontally. A lock arm 122 is formed on the middle of the upper wall of the outer housing 130. More specifically, the lock arm 122 is extended in the front-to-rear direction in such a manner that it is vertically flexible. The lock arm 122 includes: a lock pawl 122*a* which is extended upwardly from the middle of the lock arm 122; and an operating knob 122*b* at the rear end. A pair of cut-outs 123 are formed in each of the upper and lower walls of the outer housing 120 in such a manner that they are positioned on both sides of the lock arm 122 and extended to the front wall, to communicate the inside of the outer housing with the outside. Ribs 120*a* are formed on the outer surface of the outer housing 120. More specifically, two ribs 120*a* are extended upwardly from the opposed edges of the upper wall, respectively, two ribs 120*a* are extended downwardly form the opposed edges of the lower wall, respectively, and two ribs 120*a* are on the right and left side walls, respectively, in such a manner that they are all extended in the front-to-rear direction. Furthermore, a pair of outer holding members 124 which are short and cylindrical, are formed on the inner surfaces of the right and left side walls of the outer housing at a half of the height of wall, respectively, in such a manner that they are protruded inwardly (towards each other). On each of the inner surfaces of the right and left side walls of the outer housing, a pair of rotating pins 125 which are short and cylindrical, are formed near the rear opening of the outer housing in such a manner that one of the rotating pins 125 is on the upper portion of the inner surface, and the other is on the lower portion of the inner surface.

The width of the inner housings 130 is such that the latter 130 can be inserted into the outer housing 120. A pair of cylindrical bearings 131 are protruded from both side walls of each of the inner housing 130, so that, with the aforementioned rotating pins 125 engaged with the cylindrical bearings 131, the inner housings are swingable. A cut-out 131*a*, which is slightly smaller than the rotating pin 125, is formed in the front portion of the cylindrical wall of each of the cylindrical bearings 131. The cylindrical bearing 131 including the cylindrical wall is made of a material which is slightly flexible. A plate-shaped spring receiving piece 132 is protruded from the front end portion of each of the side walls of each of the inner housings 130 on which the cylindrical bearings 131 are formed. Each of the inner housings 130 has a plurality of terminal accommodating chambers 133 with inserting holes 134 opened in the rear end of the inner chamber. Metal terminals 141 are inserted into the terminal accommodating chambers 133, respectively. Each of the metal terminals 141 has a tongue-shaped abutting part 141*a* which is protruded sideward. Communicating holes 135 are formed in the predetermined walls of the inner housings 130 which are set close to each other, in such a manner that they are communicated with the terminal accommodating chambers 133, respectively. Thus, the abutting parts 141*a* of the terminals 141 are allowed to .protrude out of the inner housings 130 through the communicating holes 135, respectively. As was described before, the cylindrical bearings 131 and the spring receiving pieces 132 are protruded from the right and left side walls of each of the inner housings 130. Hence, the width of the inner housings 130 is such that the inner housings 130 set in the outer housing 120 are precisely in contact with the inner surfaces of in the outer housing 120.

A pair of spring members 142 are provided on both sides of each of the inner housings 130, respectively. Each spring member 142 is bent at the middle as indicated at 142*a* (hereinafter referred to as "a middle portion 142*a*", when applicable), and its two outer end portions 142*b* are bent outwardly. Each spring member 142 is set inside the outer housing 120 as follows: With the middle portion 142*a* engaged with the respective outer holding member 124, the spring member 142 is directed forward, and then both end portions 142*b* are engaged with the spring receiving pieces 132 of the inner housings 130.

The connecting end portion 151 of a printed circuit board is protruded from an electronic circuit housing 150, on which a cylindrical hood 152 is formed in such a manner as to surround the connecting end portion 151. The hood 152 has an inner surface which is formed in conformance with the external shape of the outer housing 120. Grooves 153 are formed in the inner surface of the hood 152, into which the above-described ribs 120*a* of the outer housing 120 are inserted. A middle portion of the upper wall of the hood 152 is raised upwardly, thus being formed into an arm inserting portion 154 with which the lock arm 122 is fixedly engaged. Introducing cams 155 are formed on the inner surfaces of the upper and lower walls of the hood 152 in correspondence to the cut-outs 123 formed in the upper and lower walls of the outer housing 120, in such a manner that the thickness of the introducing cams 155 are larger towards the back. Elongated terminals 151*a* are formed on both sides of the connecting end portion 151 of the printed circuit board. More specifically, at a predetermined edge portion of the printed circuit board, parts of the printed lines are formed into the elongated terminals 151*a* in correspondence to the communicating holes 135 of the inner housings 130.

Now, the operation of the card edge connector thus constructed will be described.

Before the assembling work of the card edge connector 110, the metal terminals 141 are inserted into the terminal accommodating chambers 133 through the inserting holes 134. In this operation, the abutting parts 141*a* of the metal terminals 141 should be faced towards the inner surfaces of the terminal accommodating chambers 133 where the communicating holes 135 have been formed, so that, when the metal terminals 141 are inserted into the terminal accommodating chambers 133, the abutting parts 141*a* are protruded through the communicating holes 135. In this connection, it goes without saying that the metal terminals may be inserted into the terminal accommodating chamber after the card edge connector 110 has been assembled.

On the other hand, the outer housing 120 is set with the rear end opening at the top. Under this condition, the spring members 142 are mounted on the inner surfaces of the right and left side walls of the outer housing 120, respectively, as follows: First, with the end portions 142*b* at the bottom (with the middle portion 142 at the top), the middle portion 142*a* of each spring member 142 is engaged with the outer holding member 124 formed on the inner surface of the side wall of the outer housing 120. Thus, the spring member 142 is held in such a manner that, in the back of the outer housing 120, the end portions 142*b* are extended towards the upper and lower walls of the outer housing 120, respectively.

Thereafter, the pair of inner housings 130 accommodating the metal terminals 141 in the above-described manner are set one on another with the predetermined walls having the communicating holes 135 confronted with each other. And the inner housings 130 thus set are inserted into the outer housing 120 in such a manner that the spring receiving pieces 132 of the inner housings 130 catch the spring members 142. With the cut-outs 131*a* of the cylindrical bearings 131 on the inner housings 130 abutted against the rotating pins 125 of the outer housing 120, the inner housings 130 are further pushed into the outer housing 120 until the rotating pins 125 are engaged with the cylindrical bearings 131 through the cut-outs 131*a*. Since the cut-outs 131*a* of the cylindrical bearings 131 are opened in the direction of insertion of the inner housings 130, the rotating pins are engaged with the cylindrical bearings as the inner housings are inserted into the outer housing.

When the inner housings 130 are pushed into the outer housing, the spring receiving pieces 132 are slid on the inner surfaces of the side walls of the outer housing 120, thus catching the spring members 142. Therefore, the spring members 142 thus caught urge the inner housings 130 through the spring receiving pieces 132 to swing away from each other. In each of the spring members 142, the end portions 142*b* are engaged with the front ends of the spring receiving pieces 132, and the middle portion 142 is engaged with the outer holding member 124. Hence, the spring members thus held will never be shifted back and forth, and they act to swing the inner housings 130 about the rotating pins 125 at all times. Thus, the card edge connector 110 has been assembled.

Figure 5:
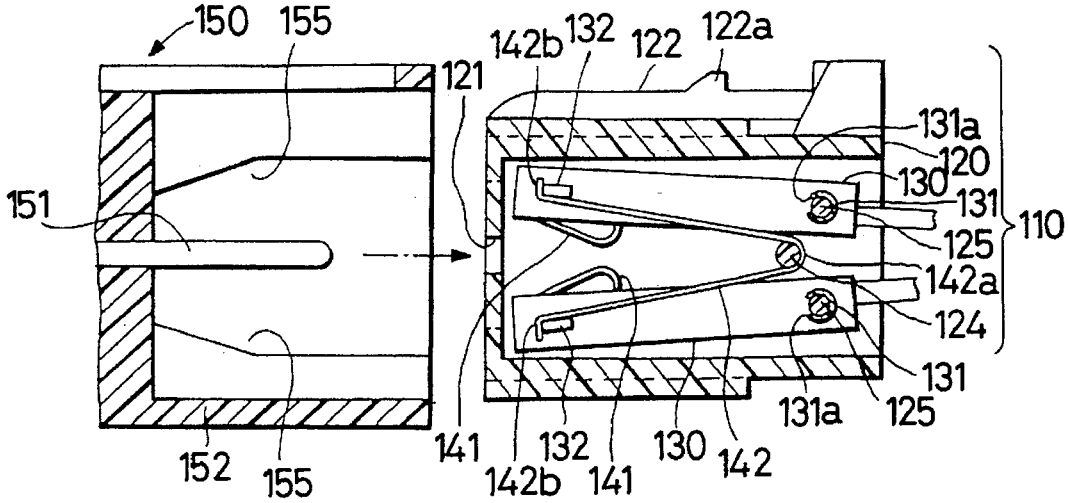
FIGS. 5 to 7 are sectional views for a description of the connection of the card edge connector shown in FIG. 4.

The card edge connector 110 thus assembled is inserted into the hood 152 of the electronic circuit housing 150 as shown in FIG. 5. With the ribs 120*a* of the outer housing 120 in alignment with the grooves 153 of the hood 152, the card edge connector 110 is gradually inserted into the hood 152. In this operation, the introducing cams 155 are inserted into the cut-outs 123 of the outer housing 120. In this case, the portions of the introducing cams 155, which are located in the cut-outs 123, are smaller in thickness than the other portions. Hence, the introducing cams 155 act to position the outer housing 120, but not protrude into the latter 120. On the other hand, the two inner housings 130 are swung about the rotating pins 124 in the opposite directions by the elastic forces of the spring members 142, so that there is a space between the inner housings 130. Therefore, when the connecting end portion 151 of the printed circuit board enters the outer housing 120 through the inserting hole 121 formed in the front end wall of the outer housing 120, it gently touches the abutting parts 141*a* of the metal terminals 141.

Figure 6:
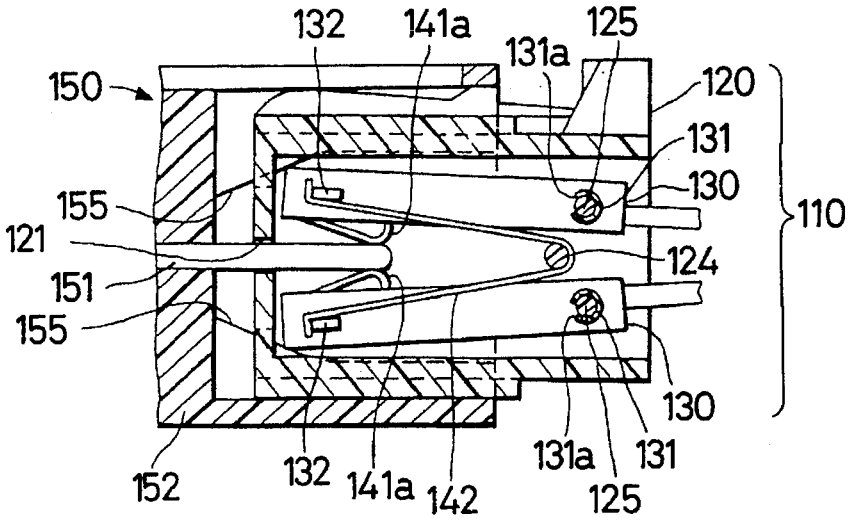

When the card edge connector is further pushed in the hood; that is, when the portions of the introducing cams 155 which are larger in thickness come in the cut-outs 123 as shown in FIG. 6, the edges of the front end faces of the inner housings 130 are brought into contact with the sloped surfaces of the introducing cams 155. The introducing cams 155 are formed on the inner surfaces of the top and bottom walls of the hood 152, and they are larger in thickness towards the back, as was described above. Therefore, when the inner housings 130 are advanced with the outer edges of the front end faces of the latter 130 abutted against the sloped surfaces of the introducing cams 155 in the above-described manner, the inner housings 130 are forced to move towards each other. As the inner housings 130 are moved towards each other in this manner, the abutting parts 141*a* of the metal terminals 141, which are protruded through the communicating holes 135, are positively pushed against the terminals 151*a* on the connecting end portion 151 of the printed circuit board. In this case, it should be noted that the abutting parts 141*a* are pushed against the connecting end portion 151 of the printed circuit board while the inner housings 130 are being swung about the rotating pins 132, and therefore the abutting parts 141 push the connecting end portion 151 substantially at right angles. That is, the connecting end portion 151 is naturally held, this being prevented from deformation.

Figure 7:
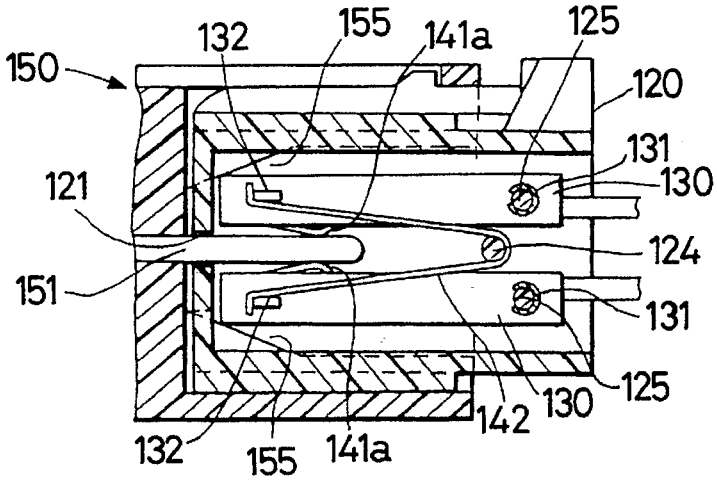

When the outer housing 120 is fully pushed into the hood 152, as shown in FIG. 7 the two inner housings 130 are set substantially in parallel with each other, and the abutting parts 141*a* hold the connecting end portion 151 of the printed circuit board from both sides, thus being electrically connected to the terminals 151*a* on the connecting end portion 151. Since the abutting parts 141 hold the connecting end portion 151 from both sides, the latter 151 is positioned at the middle of the outer housing.

As was described above, the rotating pins 125 formed on the inner surfaces of the side walls of the box-shaped outer housing 120, are engaged with the cylindrical bearings 131 formed on the outer surfaces of the side walls of the inner housings 130 accommodating the metal terminals 141, so that the inner housings 130 are swingably held in the outer housing. The cut-outs 131*a* of the cylindrical bearings 131 are opened in the direction of insertion of the inner housings. Hence, as the inner housings 130 are inserted into the outer housing 130, the cylindrical bearings 131 are engaged with the rotating pins 124 through the cut-outs 131*a*. The spring members 142 urge the inner housings 130 in such a manner that the abutting parts 141*a* are moved away from the terminals 151*a*. When the connecting end portion 151 of the printed circuit board starts to enter the outer housing, it gently touches the abutting parts 141*a*. When, thereafter, the connecting end portion is fully pushed in, the introducing cams 155 of the hood 151 surrounding the connecting end portion 151 allow the inner housings 130 to swing toward the connecting end portion, so that the abutting parts 141*a* are positively pushed against the terminals 151*a* on the connecting end portion 151 of the printed circuit board.

As was described above, in the card edge connector of the invention, the inner housings swingably held in the outer housing hold the electrically conductive terminals, and the latter are brought into contact with the exposed terminals on the connecting end portion of the plate-shaped member as the inner housings are swung. Hence, the card edge connector is free from the difficulties that the connecting end portion of the plate-shaped member greatly pushes the abutting parts of the electrically conductive terminals, thus deforming or damaging the abutting parts. In addition, the exposed terminals on the connecting end portion of the plate-shaped member can be electrically connected to the electrically conductive terminals with a relatively small force. Furthermore, the card edge connector can be assembled merely by inserting the inner housings into the outer housing. That is, the card edge connector of the invention can be assembled with high work efficiency.

Further, according to the invention, the connecting end portion of the plate-shaped member is held by the pair of inner housings from both sides, thus being prevented from being shifted in position.

Furthermore, according to the invention, normally the inner housings are kept urged to move away from the connecting end portion of the plate-shaped member, so as not to interrupt the insertion of the latter; and upon insertion of the connecting end portion of the plate-shaped member, the inner housings are driven to catch the connecting end portion of the plate-shaped member. Hence, with the card edge connected, the difficulty is eliminated that the difficulty that the connecting end portion of the plate-shaped member abuts against the inner housings at the start of insertion. The spring mechanisms can be provided merely by inserting the inner housings into the outer housing with the bent spring members engaged with the pins of the outer housings. Thus, the card edge connector of the invention is high in assembling efficiency.

Second Embodiment

Figure 8:
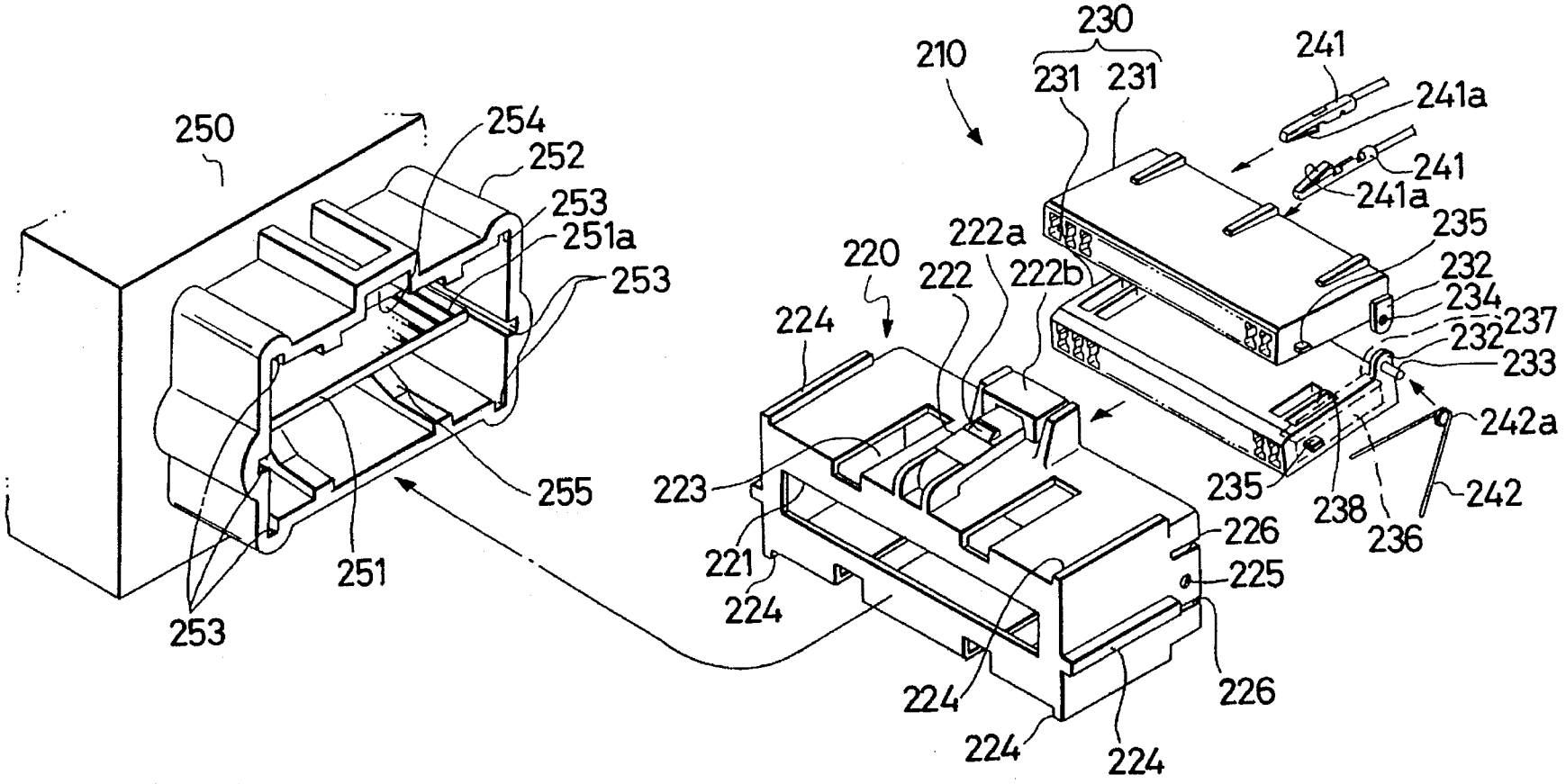
FIG. 8 is an exploded perspective view showing a card edge connector according to second embodiment of this invention.

FIG. 8 is an exploded perspective view of a card edge connection, which constitutes second embodiment of the invention.

As shown in FIG. 8, in the card edge connector 210, an inner housing assembly 230 consisting of two flat-box-shaped inner housings 231 is swingably held in a box-shaped outer housing 220. An inserting hole 221 like a slit is formed in the front wall of the box-shaped outer housing 220 in such a manner that it is extended horizontally. A lock arm 222 is formed on the middle of the upper wall of the outer housing 230. More specifically, the lock arm 222 is extended in the front-to-rear direction so that it is vertically flexible. The lock arm 222 includes: a lock pawl 222*a* which is extended upwardly from the middle of the lock arm 222; and an operating knob 222*b* at the rear end.

A pair of cut-outs 223 are formed in each of the upper and lower walls of the outer housing 220 in such a manner that they are extended both sides of the lock arm 222 to the front wall, to communicate the inside of the outer housing with the outside. Ribs 224 are formed on the outer surface of the outer housing 220. More specifically, two ribs 224 are extended upwardly from the opposite edges of the upper wall, respectively, two ribs 224 are extended downwardly form the opposite edges of the lower wall, respectively, and two ribs 224 are on the right and left side walls, respectively, in such a manner that they are all extended in the front-to-rear direction. Furthermore, each of the side walls of the outer housing 220 has a bearing hole 225 in the rear end portion at the middle, and two slits 226 above and below the bearing hole 225 which are cut from the rear edge.

As was described above, the inner housing assembly 230 consists of the two inner housings 231. The upper inner housing 231 is set upside down on the lower inner housing 231. Each of the inner housings 231 has a flat plate 232 which is extended upwardly from the upper edge of the rear end portion of one of the side walls, and a rotating pin 233 protruded outwardly from the flat plate 232; and has another flat plate 232 which is also extended upwardly form the upper edge of the rear end portion of the other side wall, and a through-hole, namely, a bearing hole 234 formed in the latter 232 which is equal in diameter to the rotating pin 233. The width of the inner housings 231 minus the rotating pins 233 is such that the inner housings 231 can be inserted into the outer housing 220. In each of the inner housings 231, flat-plate-shaped spring receiving pieces 235 are protruded outwardly from the front end portions of the side walls.

Each of the inner housings 231 has a plurality of terminal accommodating chambers 236 arranged side by side to hold metal terminals 241 with inserting holes 237 opened in the rear end. Each of the metal terminals 241 has a tongue-shaped abutting part 241*a* which is protruded sideward. Communicating holes 238 are formed in the predetermined walls of the inner housings 231 which are set close to each other when the inner housings 231 are laid one on another, in such a manner that they are communicated with the terminal accommodating chambers 236, respectively. Thus, the abutting parts 241*a* of the terminals 241 are allowed to protrude out of the inner housings 231 through the communicating holes 238, respectively.

A pair of spring members 242 are provided on both sides of the inner housing assembly 230, respectively. Each spring member 242 is coiled one turn at the middle as indicated at 242*a* (hereinafter referred to as "a middle portion 242*a*", when applicable), with two end portions 242*b* opened wide being extended in the same direction. The length of each of the spring members 242 is so determined that, with the coiled middle portion 242*a* mounted on the rotating pin 233, the end portions 242*b* are engaged with the spring receiving pieces 235 of the inner housings 231 and 231.

The connecting end portion 251 of a printed circuit board is protruded from an electronic circuit housing 250, on which a cylindrical hood 252 is formed in such a manner as to surround the connecting end portion 251. The hood 252 has an inner surface which is formed in conformance with the external shape of the outer housing 220. Grooves 253 are formed in the inner surface of the hood 252, into which the above-described ribs 224 of the outer housing 220 are inserted. A middle portion of the upper wall of the hood 252 is raised upwardly, thus being formed into an arm inserting portion 254 with which the lock arm 222 is fixedly engaged. Introducing cams 255 are formed on the inner surfaces of the upper and lower walls of the hood 252 in correspondence to the cut-outs 223 formed in the upper and lower walls of the outer housing 220, in such a manner that the thickness of the introducing cams 255 are larger towards the back. Elongated terminals 251*a* are formed on both sides of the connecting end portion 251 of the printed circuit board. More specifically, at a predetermined edge portion of the printed circuit board, parts of the printed lines are formed into the elongated terminals 251*a* in correspondence to the communicating holes 238 of the inner housings 231.

Now, the operation of the card edge connector thus constructed will be described.

Before the assembling work of the card edge connector 210, the metal terminals 241 are inserted into the terminal accommodating chambers 236 through the inserting holes 237. In this operation, the abutting parts 241*a* of the metal terminals 241 should be faced towards the inner surfaces of the terminal accommodating chambers 233 where the communicating holes 235 have been formed, so that, when the metal terminals 241 are inserted into the terminal accommodating chambers 236, the abutting parts 241*a* are protruded through the communicating holes 235. In this connection, it goes without saying that the metal terminals may be inserted into the terminal accommodating chamber after the card edge connector 210 has been assembled.

Figure 9:
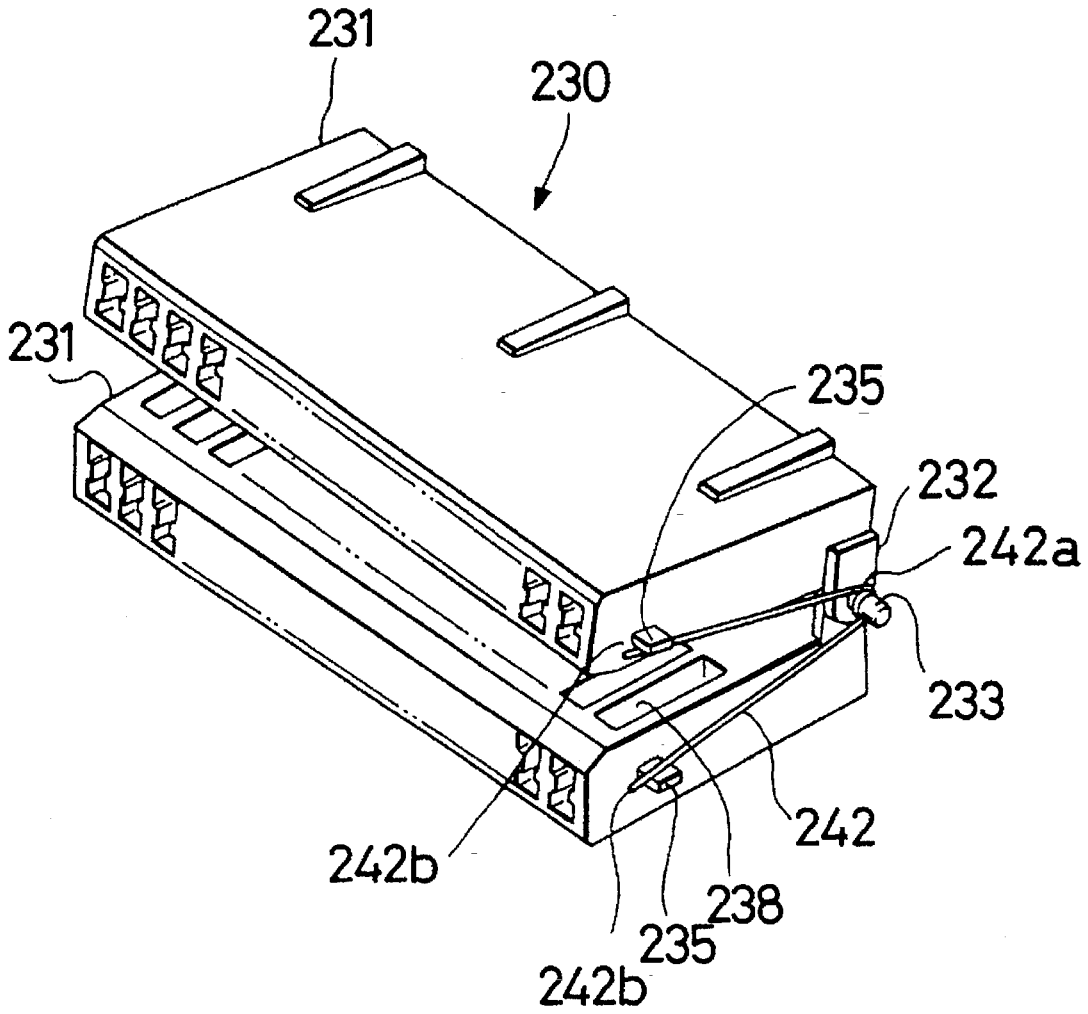
FIG. 9 is a perspective view showing an inner housing assembly including a pair of inner housings in the card edge connector.

Thereafter, the inner housings 231 are set back to back; more specifically, one of the inner housings 231 is set upside down on the other. Under this condition, the inner housings 231 are slightly slid sideward from each other, so that the rotating pins 233 are inserted into the respective bearing holes 234 from inside. Since the two inner housings 231 are equal in configuration to each other, the rotating pins 233 are inserted into the bearing holes 234 merely by sliding back the two inner housings 231. Thus, the inner housings 231 have become swingable about the rotating pins 233. As the inner housings 231 are swung in this manner, the abutting parts 241*a* of the metal terminals 241 which are protruded out of the communicating holes 238 of the housings 231, are moved to and from each other. The middle portions 242*a* of the spring members 242 are mounted on the rotating pins 233, respectively, and the end portions 242*b* are engaged with the spring receiving pieces 235 of the housings 231 and 231, so that the latter 231 are elastically forced to swing away from each other. FIG. 9 shows the inner housing assembly 30 consisting of the inner housings 231 and 231 which have been coupled to each other in the above-described manner.

The two inner housings 231 are inserted into the outer housing 220 while being swung towards each other against the elastic forces of the spring members 242. In this operation, the distance between the side walls of the outer housing 220 in which the bearing holes 225 have been formed, is increased by utilizing the slits 226 formed therein, so that the rotating pins 233 are inserted into the bearing holes 225. The inner housings 231 and 231 thus inserted are swung about the rotating pins 233 in the bearing holes 225 in the opposite directions, so that the front end portions of the inner housings 231 form a space behind the inserting hole 221 in the front wall of the outer housing 220. Thus, the card edge connector 210 has been assembled.

Figure 10:
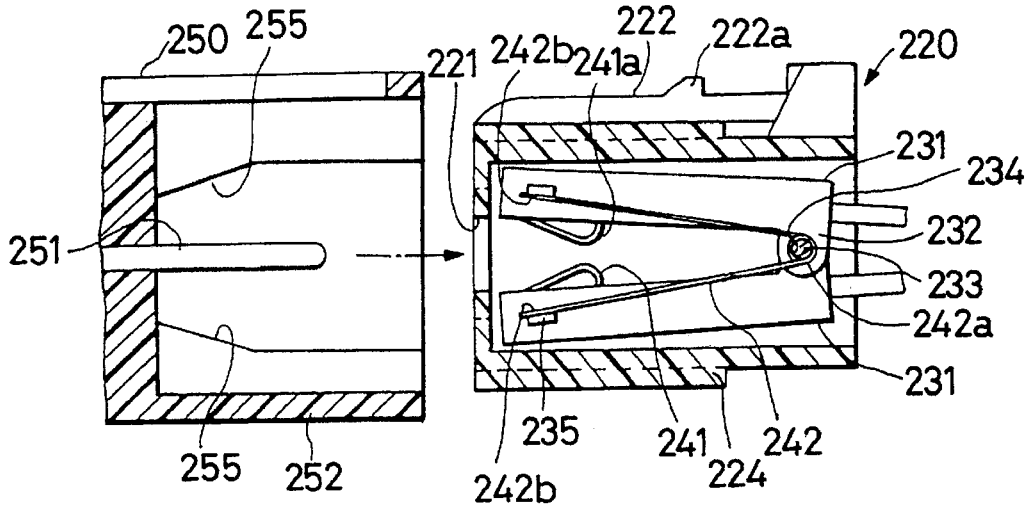
FIGS. 10 to 12 are sectional views for a description of the engagement of the card edge connector.

The card edge connector 210 thus assembled is inserted into the hood 252 of the electronic circuit housing 250 as shown in FIG. 10. With the ribs 224 of the outer housing 220 in alignment with the grooves 253 of the hood 252, the card edge connector 210 is gradually inserted into the hood 252. In this operation, the introducing cams 255 are inserted into the cut-outs 223 of the outer housing 220. In this case, the portions of the introducing cams 255, which are located in the cut-outs 223, are smaller in thickness than the other portions. Hence, the introducing cams 255 act to position the outer housing 220, but not protrude into the latter 220. On the other hand, the inner housings 231 of the inner housing assembly 230 are swung about the rotating pins 233 in the opposite directions by the elastic forces of the spring members 242, thus forming a space between them. Therefore, when the connecting end portion 251 of the printed circuit board enters the outer housing 220 through the inserting hole 221 in the front end wall of the outer housing 220, it gently touches the abutting parts 241*a* of the metal terminals 241.

Figure 11:
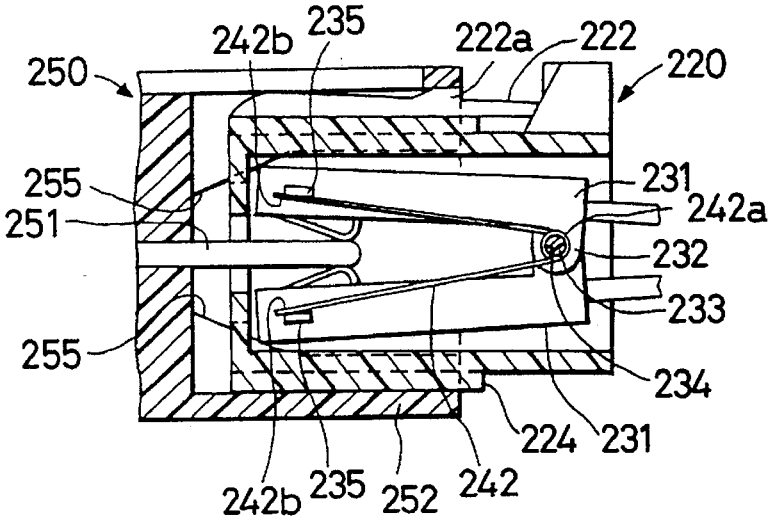

When the card edge connector is further pushed in the hood; that is, when the portions of the introducing cams 255 which are larger in thickness come in the cut-outs 223 as shown in FIG. 11, the edges of the front end faces of the inner housings 231 are brought into contact with the sloped surfaces of the introducing cams 255. The introducing cams 255 are formed on the inner surfaces of the top and bottom walls of the hood 252, and they are larger in thickness towards the back, as was described above. Therefore, when the inner housings 230 are advanced with the outer edges of the front end faces of the latter 230 abutted against the sloped surfaces of the introducing cams 255 in the above-described manner, the inner housings 231 are forced to swing towards each other. As the inner housings 230 are swung towards each other in this manner, the abutting parts 241*a* of the metal terminals 241, which are protruded through the communicating holes 238, are positively pushed against the terminals 251*a* on the connecting end portion 251 of the printed circuit board. In this case, it should be noted that the abutting parts 241*a* are pushed against the connecting end portion 251 of the printed circuit board while the inner housings 231 are being swung about the rotating pins 233 in the bearing holes 225, and therefore the abutting parts 241 push the connecting end portion 251 substantially at right angles. That is, the connecting end portion 251 is naturally held, thus being prevented from deformation.

Figure 12:
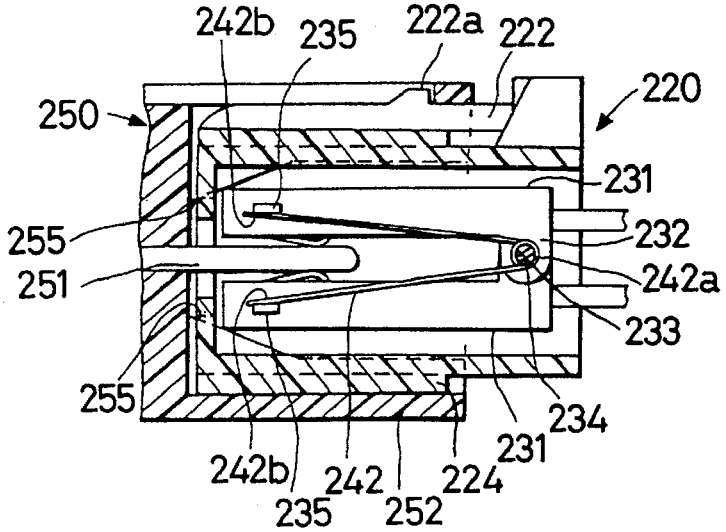

When the outer housing 220 is fully pushed into the hood 252, as shown in FIG. 12 the inner housings 231 are set substantially in parallel with each other, and the abutting parts 241*a* hold the connecting end portion 251 of the printed circuit board from both sides, thus being electrically connected to the terminals 251*a* on the connecting end portion 251. Since the abutting parts 241 hold the connecting end portion 251 from both sides, the latter 251 is positioned in place in the middle of the outer housing.

As was described above, each of the inner housings 231 has the rotating pin 233 formed on one of the flat plates 232 and the bearing hole 234 formed in the other. The rotating pin 233 and the bearing hole 234 of one of the inner housings 231 are engaged with the bearing hole 234 and the rotating pins 234 of the other, respectively, thus forming a pair of hinge mechanisms each consisting of a male member, namely, the rotating pin 233, and a female member, namely, the bearing hole. That is, the inner housings 231 and 231 are swingable about the hinge mechanisms. Hence, as the inner housings 231 and 231 are swung in this manner, the abutting parts 241*a* of the metal terminals 241 held in the inner housings 231 and 231 are moved to and from each other. The inner housing assembly 230 including the inner housings 231 and 231 is inserted into the outer housing 220, and in the latter 220 the inner housings 231 and 231 are swingable in the above-described manner.

The spring members 242 urge the inner housings 231 and 231 in such a manner that the abutting parts 241*a* are moved away from the terminals 251*a*. When the connecting end portion 251 of the printed circuit board starts to enter the outer housing 220, it gently touches the abutting parts 241*a*. When, thereafter, the connecting end portion is fully pushed in, the introducing cams 255 of the hood 251 surrounding the connecting end portion 251 allow the inner housings 231 and 231 to swing toward the connecting end portion, so that the abutting parts 241*a* are positively pushed against the terminals 251*a* on the connecting end portion 251 of the printed circuit board.

Figure 13:
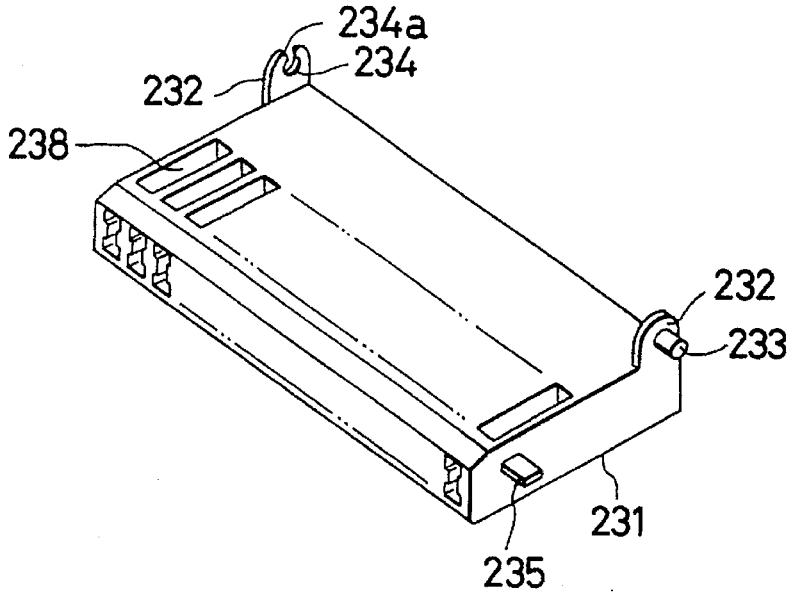
FIGS. 13 and 14 are perspective views showing one modification of the inner housing in the card edge connector of the invention.
Figure 14:
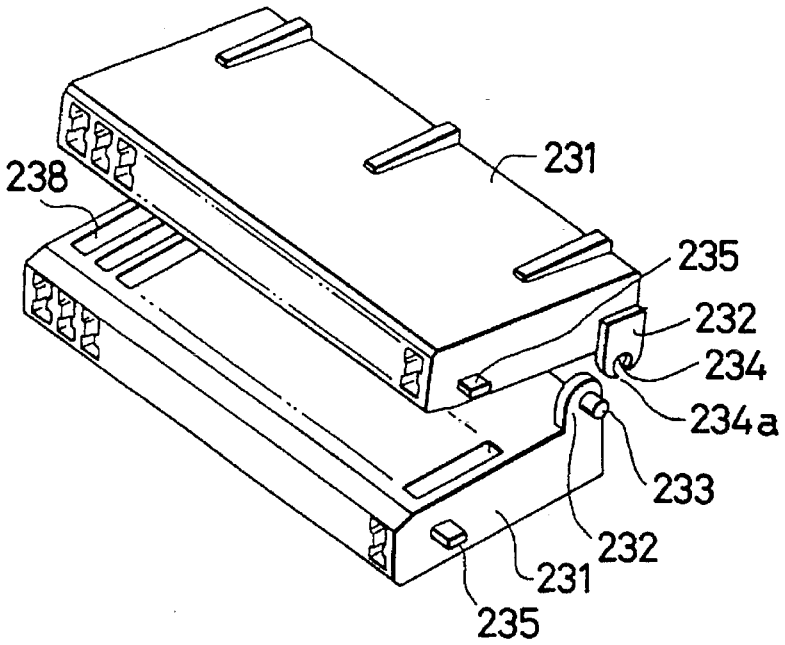

FIG. 13 shows one modification of the above-described inner housings 231 forming the inner housing assembly 230. As shown in FIG. 13, the upper portion of the flat plate 231 which defines the bearing hole 234 has a cut 234*a* the width of which is slightly smaller than the diameter of the rotating pin 233. The inner housing 231 including the flat plate 231 is made of a material which is slightly flexible.

With the modification, in inserting the rotating pins 233 of the inner housings 231 into the bearing holes 234, it is unnecessary to slide the inner housings 231 sideward; that is, the rotating pins 233 can be engaged with the bearing holes 234 through the cuts 234*a* in a snap—by pushing the rotating pins 233 through the cuts 234*a* into the bearing holes 234.

The hinge mechanisms may be a flexible thin member through which the housings 231 and 231 is coupled to each other. In the above-described card edge connector, the edges of the front end walls of the inner housings 231 are abutted against the introducing cams 255 of the hood 252, to swing the inner housings 231; however, the turning mechanism may be obtained by using other cams or protrusions which are different in configuration from the above-described introducing cams.

As was described above, the inner housings rotatably held in the outer housing have the electrically conductive terminals, which are abutted against the exposed terminals on the connecting end portion of the plate-shaped member as the inner housings are swung. Hence, with the card edge connector, the connecting end portion of the plate-shaped member will not excessively push the abutting parts of the electrically conductive terminals; that is, the abutting parts are prevented from being deformed or damaged, and only a small force is required to electrically connect the conductive terminals in the inner housings to the exposed terminals on the connecting end portion of the plate-shaped member with a small force. The inner housings are assembled before they are inserted into the outer housing. Hence, the card edge connector can be assembled with high work efficiency.

Further, the inner housings are swingably coupled to each other through the male and female members which are protruded towards each other. Hence, the inner housings can be readily coupled to each other.

Furthermore, the inner housings equal in configuration to each other are coupled to each other by setting one of the inner housings upside down on the other inner housing. This will contribute to reduction of the number of components.

Third Embodiment

Third embodiment of the invention will be described with reference to FIGS. 15 through in detail.

Four supporting cylinders 301*d* are held upright on the bottom wall of a box-shaped board holder 301 near four corners, and four holes 301*a* are formed in the top wall of the board holder 301 in correspondence to the four supporting cylinder 301*d*. With retaining screws 301*b* inserted into the board holder 301 through the holes 301*a*, a printed circuit board 302 inserted into the board holder 301 from behind is held substantially horizontal. The front end portion of the printed circuit board 302 is formed into a connecting end portion 304, on each of the upper and lower surface of which a plurality of terminal 303 are arranged side by side in the direction of width. The board holder 301 has a hood-shaped and laterally elongated engaging mouth 305 on its front end wall. The connecting end portion 304 is held in a engaging mouth 305 in such a manner that it is spaced from the inner surfaces of the engaging mouth 305.

On each of the inner surfaces of the upper and lower walls of the engaging mouth 305, a pair of ribs 306 are formed in such a manner that they are extended from the opening edge of the engaging mouth 305 to the back. Each of the ribs 306 has a sloped surface 306*a* which is so inclined that the distance between the sloped surface and the printed circuit board 302 is smaller toward the back of the engaging mouth 305. On each of the inner surfaces of the side walls of the engaging mouth 305, a guide groove 307 is formed in such a manner that it is extended from the opening edge of the engaging mouth 305 to the back.

Figure 16:
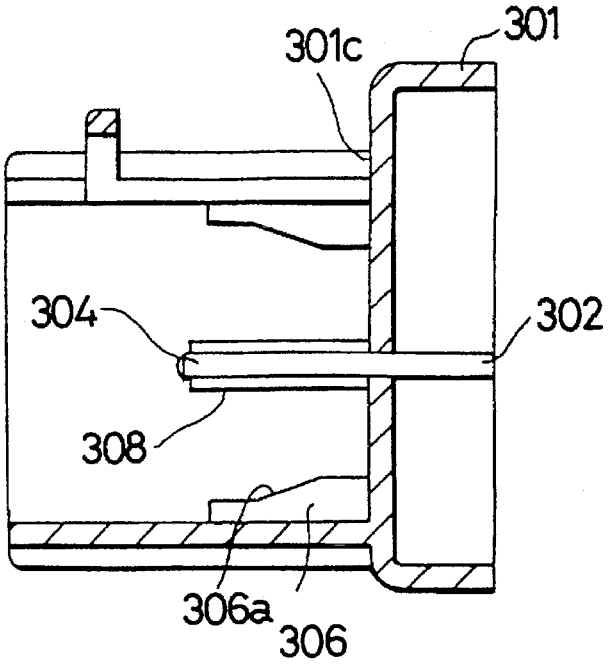
FIG. 16 is a fragmentary sectional view of the board holder.

Inside the engaging mouth 305, posture correcting members 308 are protruded from the engaging surface 301*c* of the board holder 301. More specifically, they are set back from the guide grooves 307 and are located substantially at the same height as the latter 307 so as to hold the connecting end portion 304 of the printed circuit board 302 from both sides. In other words, the posture correcting members 308 are substantially U-shaped in section, having grooves, and are set on the inner surfaces of the side walls of the engaging mouth 305 in such a manner that the openings of the grooves are confronted with each other. The width of the grooves are so determined that the posture correcting members 308 are engaged with the connecting end portion 304 of the printed circuit board substantially without a gap between them. The posture correcting members 308, as shown in FIG. 16, are held substantially perpendicular to the engaging surface 301*c* of the board holder 301. Hence, the posture correcting members 308 hold the connecting end portion 304 of the printed circuit board 302 with their grooves, thus causing the connecting end portion 304 to be extended substantially at right angles with the engaging surface 301*c*.

Now, a card edge connector 310, which is to be engaged with the board holder 301, will be described (cf. FIG. 17).

The card edge connector 310 comprises an outer housing 311, and upper and lower inner housings 320.

The outer housing 311 is in the form of a box which is so designed in dimension and in configuration that it can be suitably inserted into the engaging mouth 305 of the board holder 301. The rear end of the outer housing 311 is fully opened, and the outer housing 311 has a laterally elongated slit-shaped inserting hole 312 in the front end.

Figure 17:
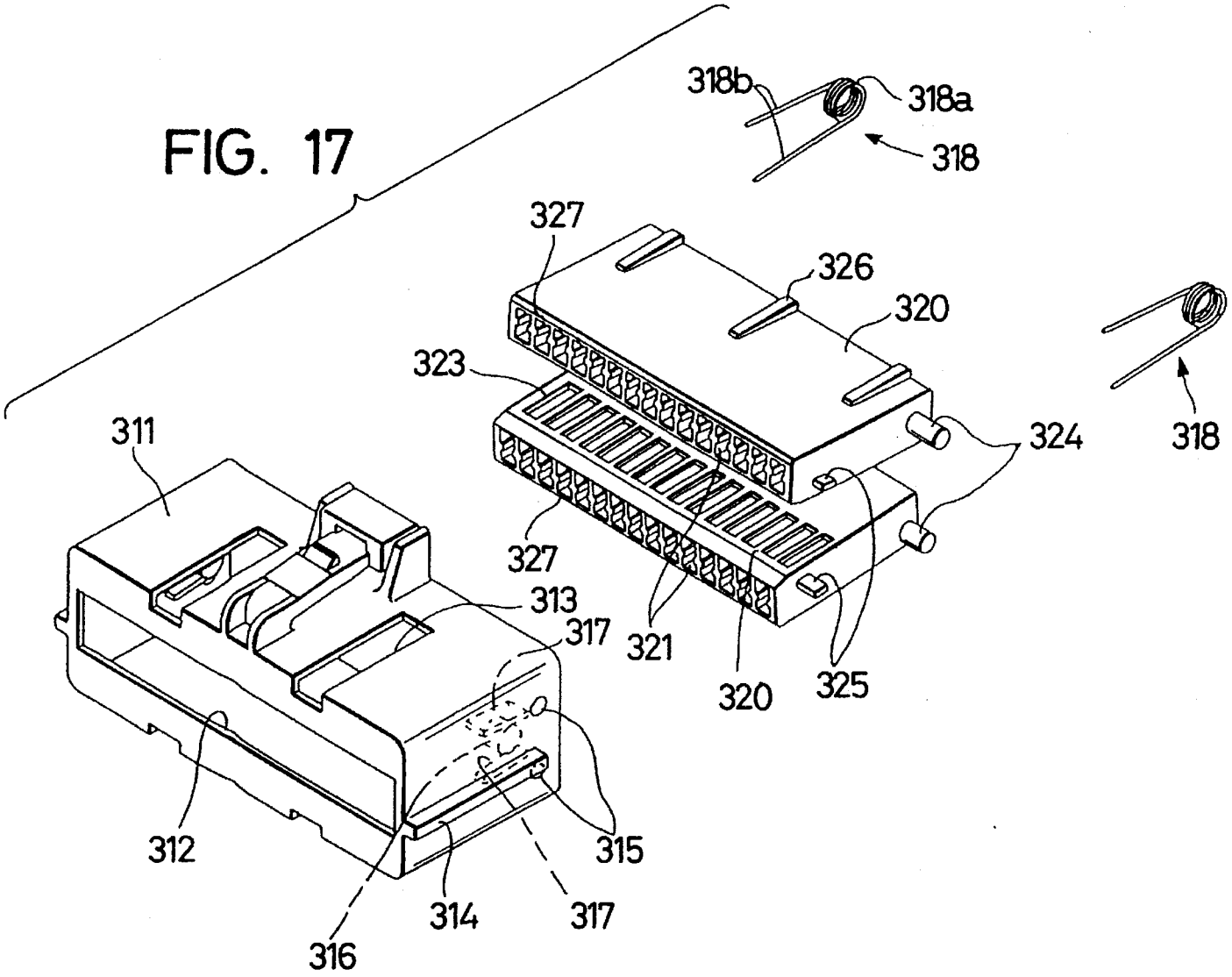
FIG. 17 is an exploded perspective view of the card edge connector.

As shown in FIG. 17, a pair of bearing holes 315 and 315 are formed in the rear end portion of each of the right and left side walls of the outer housing 311 in such a manner that they are positioned substantially on a vertical line to support the inner housings 320. Spring supporting pins 316 are provided adjacent to the bearing holes 315 in such a manner that they are coaxial with each other. A pair of spring receiving members 317 are provided in front of each of the spring supporting shafts 316 in such a manner that they are vertically spaced from each other. A pair of torsion coil springs 318 are provided on both sides walls of the outer housing 311, respectively, as follows: On each of the side Walls, the torsion coil spring 318 is provided with the coil 318*a* mounted on the spring supporting pin 316 and with the straight arms 318*b* locked to the spring receiving members 317.

Now, the inner housings 320 will be described. As shown in FIG. 17, the inner housings 320 are each in the form of a thick plate, and they are set one on another. In each of the inner housings 320, a plurality of holding holes 321 are formed in such a manner that they are extended in the front-to-rear direction and are arranged side by side. In each of the holding holes 321, an elongated electrically conductive terminal 322 is fixedly inserted. The terminal 322 has an abutting part 322*a* at the front end which is elastically deformable being made of a curved thin plate. As shown in FIG. 17, the abutting parts 322*a* of the terminals 322 are so held that they appear in openings 323 which are formed in the walls of the inner housings 320 which are confronted with each other when the inner housings 320 are set one on another.

As shown in FIG. 17, a pair of rotating pins 324 are protruded from the right and left side walls of each of the inner housings 320 in such a manner that they are coaxial with each other, and a pair of spring receiving protrusions 325 are formed on the right and left side walls near the front end. Play preventing pieces 326 are formed on the outer surface of the upper wall of the upper inner housing 320, and on the outer surface of the lower wall of the lower inner housing 320 (the play preventing pieces 326 of the lower inner housing 320 not shown). The upper edge of the front end face of the upper inner housing 320, and the lower edge of the front end face of the lower inner housing 320 are employed as sliding parts 327 which are slidably brought into contact with the ribs 306 of the board holder 301.

The inner housings 320 are set in the outer housing 311 in such a manner that the rotating pins 324 are engaged With the bearing holes 315, and the straight arms 318*b* of the torsion coil springs 318 are locked to the spring receiving protrusions 325. When the inner housings 320 are set in the above-described manner, they are vertically swingable about the rotating pins 324, and they are urged by the elastic forces of the torsion coil springs 328 so that the front end portions are moved away from each other, and the play preventing pieces 326 are in abutment with the inner surface of the outer housing 311.

The printed circuit board 302 is secured to the board holder 301, and the card edge connector 310 is engaged with the board holder 301 and connected to the printed circuit board 302 as follows:

The printed circuit board 302 is inserted into the board holder 301 from behind, and both sides of the connecting end portion 304, which is the front end portion of the printed circuit board thus inserted, are made in alignment with the base ends of the posture correcting members 306. Under this condition, both sides of the connecting end portion 304 are engaged with the grooves (U-shaped in section) of the posture correcting members 308, and the printed circuit board 302 is further inserted into the board holder 301 until the connecting end portion 304 is protruded through the engaging surface 301*c* of the board holder 301. In this state, both sides of the connecting end portion 304 are held by the posture correcting members 308. Hence, even if the printed circuit board 302 is, for instance, curved, it is straightened by the posture correcting members, so that the connecting end portion 304 thus protruded is substantially perpendicular to the engaging surface 301*c* (cf. FIGS. 15 and 16). Under this condition, the printed circuit board 302 is fixedly secured to the board holder 301 with the retaining screws 301*b*. The rear end of the board holder 301 is closed with a rear cover.

Figure 15:
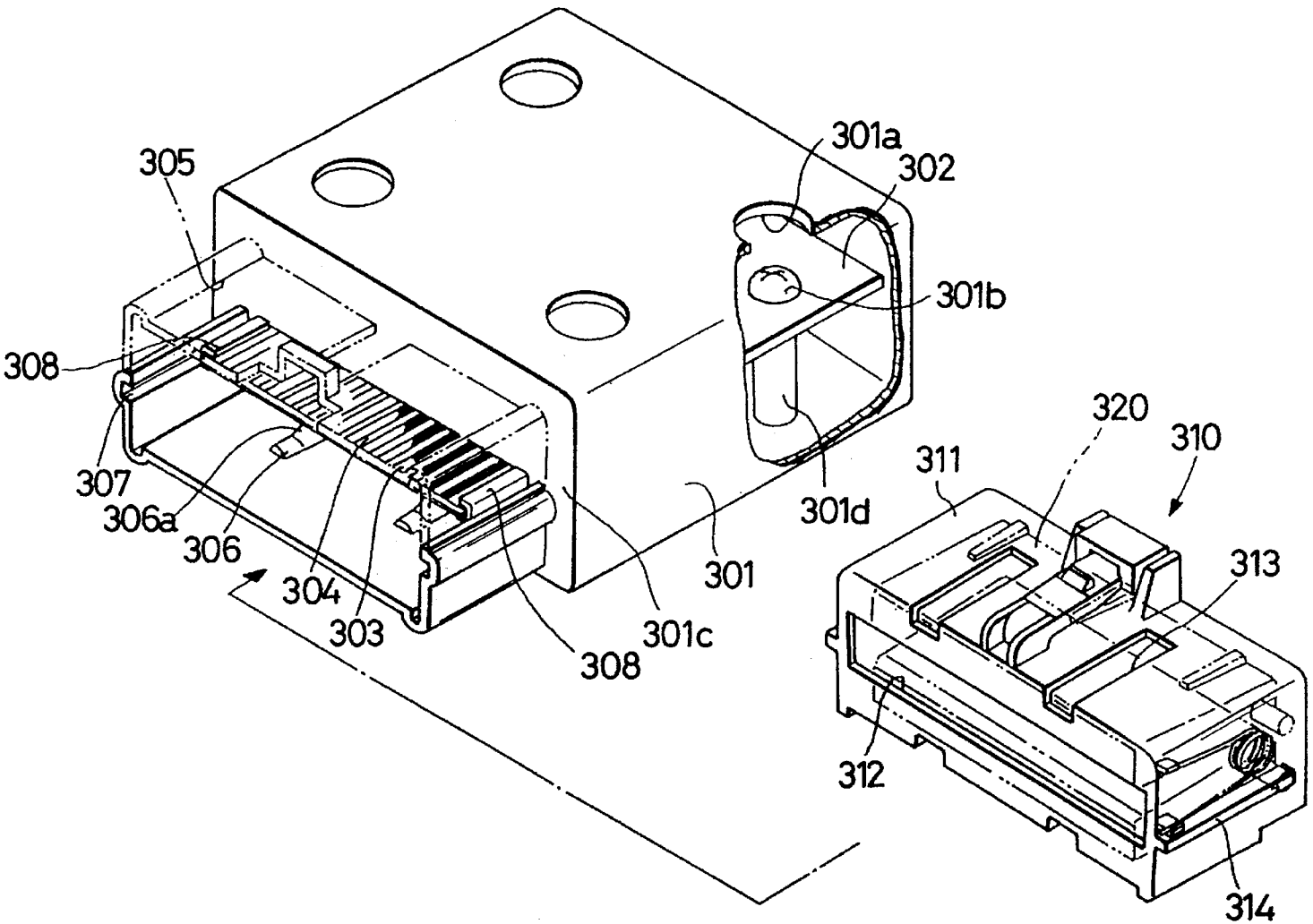
FIG. 15 is a perspective view of a board holder and a card edge connector disconnected from the other.

As shown in FIG. 15, with the guide grooves 307 in alignment with the guide ribs 314, the card edge connector 310 is inserted into the engaging mouth 305 of the board holder 301 beginning with the front end. In this operation, the inserting hole 312 of the card edge connector 310 meets with the connecting end portion 304 of the printed circuit board 302 while the ribs 306 of the engaging mouth 305 are engaged with slots 313 formed in the card edge connector 310, and the posture correcting members 308 meet the inserting hole 312.

As the card edge connector 310 is moved towards the back as it is, the abutting parts 322*a* of the terminals 322 thereof are brought into contact with the edges of the upper and lower surfaces of the connecting end portion 304 of the printed circuit board 302 while the sliding parts 327 of the front end faces of the inner housings 320 are abutted against the sloped surfaces 306*a* of the ribs 306.

Figure 18:
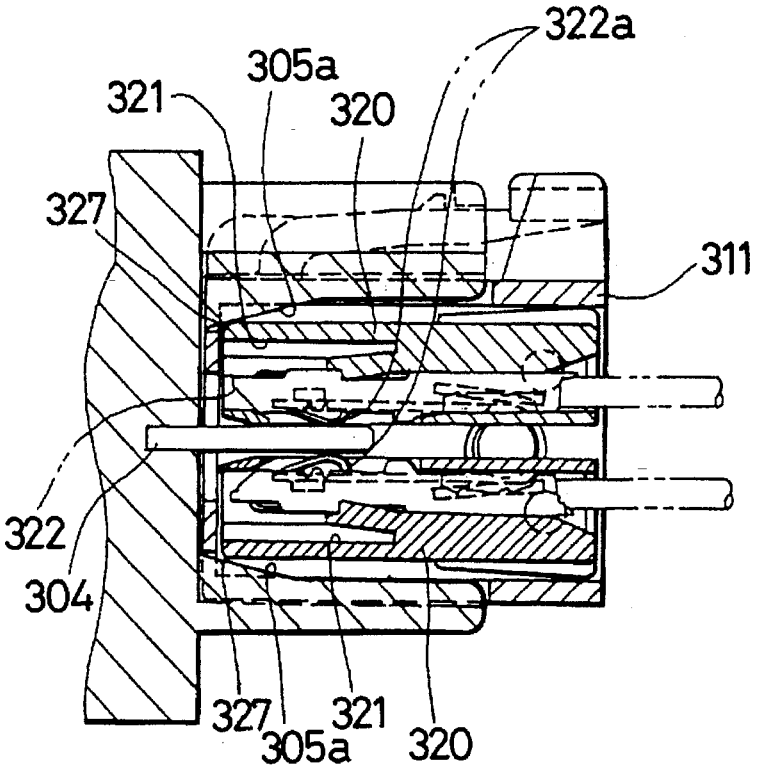
FIG. 18 is a fragmentary sectional view showing the card edge connector which has been engaged with the connecting end portion of a printed circuit board.

As the card edge connector 310 is further moved towards the back, the sliding parts 327 of the inner housings 320 slide on the sloped surfaces 306*a* of the ribs 306, so that the inner housings 320 are swung against the elastic forces of the torsional coil springs 318 so that the front end portions of the inner housings 320 come closer to each other to hold the connecting end portion 304 of the printed circuit board 302. As a result, the abutting parts 322*a* of the terminals 322 are slightly elastically deformed, thus being positively abutted against the terminals 303 on the upper and lower surfaces of the connecting end portion 304 of the printed circuit board 302. Thus, the engagement of the card edge connector with the printed circuit board has been achieved as shown in FIG. 18.

As was described above, the connecting end portion 304 of the printed circuit board is never deflected vertically no matter how the printed circuit board 302 is fixed in the board holder—for instance even when it is curved. Hence, the connecting end portion can be smoothly engaged with the card edge connector 310 with high efficiency.

Furthermore, since the connecting end portion 304 of the printed circuit board is prevented from vertically deflected, the connecting end portion 304 will never be twisted when engaged with the card edge connector 310. Hence, the abutting parts 322*a* of the electrically conductive terminals 322 of the card edge connector 310 are prevented from being deformed or damaged, which means that the engagement of the card edge connector with the printed circuit board is high in reliability.

In the above-described embodiment, the posture correcting members 308 are provided on both sides of the connecting end portion 304 of the printed circuit board 302; however, the embodiment may be so modified that the posture correcting member is provided only on one side of the connecting end portion 304.

Furthermore, the posture correcting member may be so modified that it has teeth to vertically push the parts of the connecting end portion 304 which parts are located between the terminals 303.

What is claimed is:

1. A card edge connector having a plurality of electrically conductive terminals, abutting parts of said terminals being brought into contact with exposed terminals formed on a connecting end portion of a circuit board to be mounted in an electrical connection housing, said card edge connector comprising:

a pair of inner housings defining an upper housing and a lower housing with a space therebetween, each of said housings holding said electrically conductive terminals in such a manner that said abutting parts are protruded to a direction toward said circuit board;

an outer housing having an upper wall, a lower wall, a first end wall and a second end wall, said first end wall having an inserting hole into which said connecting end portion of said circuit board is inserted, and said second end wall having an opening opposite to said first end wall through which said pair of inner housings is inserted into said outer housing, said outer housing accommodating said pair of inner housings therein; and a spring attached to at least one of said pair of inner housings for urging said upper housing of said pair of inner housings toward said upper wall and for urging said lower housing of said pair of inner housings toward said lower wall of said outer housing to define said space between said pair of inner housings at where said connecting end portion of said circuit board is inserted, at least one slit hole provided on said upper and lower walls of said outer housing; and introducing cams of the electrical connection housing capable of being inserted into said at least one slit hole, wherein said connecting end portion of said circuit board is inserted into said outer housing and said pair of inner housings are moved to each other to close said space by said introduction cams.

2. A card edge connector having a plurality of electrically conductive terminals, said plurality of terminals having abutting parts which are brought into contact with exposed terminals which are formed on a connecting end portion of a plate-shape member to be mounted in an electrical connection housing at predetermined positions, thus being electrically connected to said terminals, said card edge connector comprising:

inner housings holding said electrically conductive terminals in such a manner that said abutting parts thereof are protruded in a predetermined direction;

an outer housing having a first end wall and a second end wall, said first end wall having an inserting hole in into which said connecting end portion of said plate-shaped member is inserted, and said second end wall having an opening opposite to said first end wall through which said inner housings are inserted into said outer housing;

hinge mechanisms positioned on at least one of the inner housings and the outer housing that rotatably hold said inner housings in said outer housing, said abutting parts of said electrically conductive terminals held in said inner housings are brought into or out of contact with said exposed terminals on said connecting end portion of said plate-shaped member by rotational movement of the inner housings when said connector end portion of said plate-shaped member is inserted into said outer housing; and a camming mechanism of the electrical connection housing that rotates said inner housings in such a manner that, when said connecting end portion of said plate-shaped member is inserted into said outer housing, said abutting parts of said electrically conductive terminals held in said inner housings are brought into contact with said exposed terminals on said connecting end portion of said plate-shaped member, and when said connecting end portion of said plate-shaped member is removed from said outer housing, said abutting parts of said electrically conductive terminals are not in contact with said connector end portion of said plate-shaped member.

3. A card edge connector as claimed in claim 2, said outer housing includes side walls having inner and outer surfaces, wherein each of said hinge mechanisms comprises:

a pair of rotating pins and cylindrical bearings, one being formed on the inner surface of said side walls of said outer housing while the other being formed on the outer surfaces of said side walls of said inner housings, said cylindrical bearings being engaged with said pair of rotating pins so as to swingably hold said inner housings, each cylindrical bearing having a cylindrical side wall in which a cut-out is formed, so that each said rotating pin is held in said cylindrical bearing when pushed through said cut-out thereinto from the side, said cut-out opened to receive said pair of pins when said inner housings are inserted into said outer housing.

4. A card edge connector as claimed in claim 3, wherein said outer housing has a locking arm extending from a front-to-rear direction and being flexible in vertical.

5. A card edge connector as claimed in claim 3, wherein a pair of said inner housings are provided for said exposed terminals on both sides of said connecting end portion of said plate-shaped member.

6. A card edge connector as claimed in claim 5, further comprising spring mechanisms between said inner housings for turning said inner housings to move said abutting parts of said electrically conductive terminals away from said exposed terminals of said connecting end portion of said plate-shaped member.

7. A card edge connector as claimed in claim 6, wherein each of said spring mechanism comprises:

an outer holding member formed on the inner surface of said side wall of said outer housing in such a manner that said outer holding member is located between said rotating pins of each of said hinge mechanisms;

a pair of inner holding members formed respectively on the outer surfaces of the side walls of said pair of inner housings which are on the side where each of said hinge mechanisms is provided, in such a manner that said inner holding members are protruded toward the inner surfaces of the side walls of said outer housing; and a pair of elastic spring members each comprising a middle portion and the remaining end portions, said electric spring members being each mounted between said outer housing and said pair of inner housings with said middle portion locked to said outer holding member and with said end portions engaged with said inner holding members to swing said pair of inner housings away from each other.

8. A card edge connector having a plurality of electrically conductive terminals, said plurality of terminals having abutting parts which are adapted to be brought into contact with exposed terminals which are formed on a connecting end portion of a plate-shape member to be mounted in an electrical connection housing at predetermined positions, thus being electrically connected to said exposed terminals, said card edge connector comprising:

an inner housing assembly including:

a pair of box-shaped inner housings for holding said electrically conductive terminals in such a manner that, in each of said pair of inner housings, said abutting parts are protruded in a predetermined direction; and a hinge mechanism that rotatably holds said pair of inner housings so that said abutting parts in one of said pair of inner housings are confronted with said abutting parts in the other of said pair of inner housings, so that said abutting parts are moved to and away from each other as said pair of inner housings rotate;

an outer housing having a first end wall and a second end wall, said first end wall having an inserting hole into which said connecting end portion of said plate-shaped member is inserted, and said second end wall having an opening opposite to said first end wall through which said inner housing assembly is inserted into said outer housing, said inner housing assembly swingably accommodated in said outer housing; and a biasing mechanism for rotating said pair of inner housings of said inner housing assembly about said hinge mechanism so that, when said connecting end portion of said plate-shaped member is inserted into said outer housing, said abutting parts of said electrically conductive terminals held in said pair of inner housings of said inner housing assembly are brought into contact with said exposed terminals on said connecting end portion of said plate-shaped member, and when said connecting end portion of said plate-shaped member is removed from said outer housing, said abutting parts are moved out of contact.

9. A card edge connector as claimed in claim 8, each said inner housing having a side wall, wherein said hinge mechanism comprises:

a male member which is protruded from said side wall of one of said pair of inner housing of said inner housing assembly to said side wall of the other of said pair of inner housings and said male member having a rotating pin extended therefrom along the axis of rotation of said one of said pair of inner housings; and a female member which is protruded from said side wall of the other of said pair of inner housings to said side wall of said one inner housing, and has a through-hole into which said rotating pin is inserted.

10. A card edge connector as claimed in claim 9, wherein each of said pair of inner housings has said male member and said female member.

11. A card edge connector as claimed in claim 8, wherein said outer housing has a flexible locking arm extending from a front-to-rear direction and being flexible in vertical.

* * * * *